US010775043B2

(12) United States Patent
Portillo Bilbao et al.

(10) Patent No.: US 10,775,043 B2
(45) Date of Patent: Sep. 15, 2020

(54) COMBUSTOR AND METHOD FOR DAMPING VIBRATIONAL MODES UNDER HIGH-FREQUENCY COMBUSTION DYNAMICS

(71) Applicant: Siemens Aktiengesellschaft, Munich (DE)

(72) Inventors: Juan Enrique Portillo Bilbao, Oviedo, FL (US); Rajesh Rajaram, Winter Park, FL (US); Christian Beck, Essen (DE); Olga Deiss, Düsseldorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 373 days.

(21) Appl. No.: 15/512,943

(22) PCT Filed: Oct. 6, 2014

(86) PCT No.: PCT/US2014/059272

§ 371 (c)(1),
(2) Date: Mar. 21, 2017

(87) PCT Pub. No.: WO2016/057009

PCT Pub. Date: Apr. 14, 2016

(65) Prior Publication Data

US 2017/0292709 A1 Oct. 12, 2017

(51) Int. Cl.

| | |
|---|---|
| ***F23R 3/34*** | (2006.01) |
| ***F23R 3/00*** | (2006.01) |
| *F23R 3/28* | (2006.01) |

(52) U.S. Cl.

CPC ..... *F23R 3/002* (2013.01); *F23R 3/286* (2013.01); *F23R 3/34* (2013.01); *F23R 3/346* (2013.01); *F23R 2900/00014* (2013.01)

(58) Field of Classification Search

CPC ..... F05D 2270/14; F05D 2260/96; F05D 2260/963; F05D 2260/964; F23R 3/286;
(Continued)

(56) References Cited

U.S. PATENT DOCUMENTS 5,235,814 A * 8/1993 Leonard ..... F23R 3/283 60/738
5,685,157 A 11/1997 Pandalai et al.
(Continued)

FOREIGN PATENT DOCUMENTS

CN 102588503 A 7/2012
CN 103620307 A 3/2014
(Continued)

OTHER PUBLICATIONS

PCT International Search Report and Written Opinion dated Jul. 21, 2015 corresponding to PCT Application No. PCT/US2014/059272 filed Oct. 6, 2014.

*Primary Examiner* — William H Rodriguez

(57) ABSTRACT

A combustor and a method involving burner mains structurally configured to damp vibrational modes that can develop under high-frequency combustion dynamics are provided. The combustor may include a carrier (12), and a plurality of mains (16) disposed in the carrier. Some of the mains (labeled with the letter X) include a body having a different structural feature relative to the respective bodies of the remaining mains. The mains with the different structural feature may be selectively grouped in the carrier to form at least one set of such mains effective to damp predefined vibrational modes in the combustor.

13 Claims, 3 Drawing Sheets

(58) Field of Classification Search
CPC .. F23R 3/34; F23R 3/343; F23R 2900/00013; F23R 2900/00014; F23R 3/28; F23R 3/283; F23R 3/30; F23R 3/32; F23R 3/346; F23R 3/36; F23D 11/12; F23D 11/36; F23D 14/46; F23D 14/58; F23D 14/583; F23D 2203/101
USPC ..... 60/725
See application file for complete search history.

(56) References Cited

U.S. PATENT DOCUMENTS 6,269,646 B1 8/2001 Lovett et al.
6,430,930 B1 * 8/2002 Andersson ..... F23D 23/00 431/114
6,530,221 B1 3/2003 Sattinger et al.
6,595,002 B2 * 7/2003 Weisenstein ..... F23D 11/36 431/1
6,931,853 B2 * 8/2005 Dawson ..... F23R 3/286 431/114
7,080,514 B2 7/2006 Bland et al.
8,381,525 B2 * 2/2013 Elkady ..... F02C 3/22 60/39.12
2003/0051478 A1 * 3/2003 Matsuyama ..... F23R 3/286 60/725
2005/0034918 A1 2/2005 Bland et al.
2005/0144956 A1 * 7/2005 Alkabie ..... F23D 11/103 60/772
2007/0028593 A1 2/2007 Guo
2008/0053097 A1 3/2008 Han et al.
2008/0141645 A1 * 6/2008 Evulet ..... F02C 3/22 60/39.12
2009/0241548 A1 10/2009 Danis et al.
2010/0005804 A1 1/2010 Chen et al.
2010/0058040 A1 3/2010 Helmecke et al.
2010/0319349 A1 12/2010 Rajaram et al.
2012/0006028 A1 1/2012 Lee et al.
2012/0006029 A1 1/2012 Bilbao et al.
2012/0180495 A1 * 7/2012 Uhm ..... F23R 3/04 60/772
2013/0042619 A1 * 2/2013 Bobba ..... F23R 3/002 60/725
2013/0104552 A1 5/2013 Uhm et al.
2013/0180251 A1 7/2013 Hase et al.
2014/0033718 A1 * 2/2014 Manoharan ..... F23R 3/10 60/725
2014/0090389 A1 4/2014 Stuttaford et al.
2014/0109587 A1 4/2014 Crothers et al.
2014/0123649 A1 5/2014 Portilllo Bilbao et al.
2014/0144152 A1 * 5/2014 Uhm ..... F02C 7/22 60/776
2014/0157779 A1 * 6/2014 Uhm ..... F23R 3/286 60/725
2014/0283522 A1 * 9/2014 Boardman ..... F23R 3/286 60/772
2015/0101332 A1 * 4/2015 Bothien ..... F23R 3/26 60/725
2017/0328568 A1 * 11/2017 Portillo Bilbao ..... F23R 3/286
2019/0056112 A1 * 2/2019 Natarajan ..... F23R 3/50

FOREIGN PATENT DOCUMENTS

EP 2559944 A2 2/2013
JP H05196232 A 8/1993
JP 2004509313 A 3/2004
JP 2010230199 A 10/2010
JP 2011047401 A 3/2011
JP 2011516809 A 5/2011
JP 2012068015 A 4/2012
JP 2012149868 A 8/2012
JP 2014040999 A 3/2014
JP 2014102064 A 6/2014
JP 2015532412 A 11/2015
JP 2015219004 A 12/2015

* cited by examiner

COMBUSTOR AND METHOD FOR DAMPING VIBRATIONAL MODES UNDER HIGH-FREQUENCY COMBUSTION DYNAMICS

BACKGROUND

1. Field

Disclosed embodiments are generally related to a combustor and a method as may be used in a turbine engine, such as a gas turbine engine, and, more particularly, to a combustor and a method involving burner mains configured to damp vibrational modes that can develop under high-frequency combustion dynamics.

2. Description of the Related Art

A turbine engine, such as a gas turbine engine, comprises for example a compressor section, a combustor section and a turbine section. Intake air is compressed in the compressor section and then mixed with a fuel. The mixture is burned in the combustor section to produce a high-temperature and high-pressure working gas directed to the turbine section, where thermal energy is converted to mechanical energy.

During combustion of the mixture, relatively high-frequency thermo-acoustic oscillations can occur in the combustor as a consequence of normal operating conditions depending on fuel/air stoichiometry, total mass flow, and other operating conditions. These thermo-acoustic oscillations can lead to unacceptably high levels of pressure oscillations in the combustor that can result in mechanical and/or thermal fatigue to combustor hardware.

One known technique to mitigate such thermo-acoustic oscillations, involves use of Helmholtz-type resonators. See for example U.S. Pat. No. 7,080,514. Further techniques effective to reliably and cost-effectively mitigate such thermo-acoustic oscillations are desirable.

DETAILED DESCRIPTION

Figure 1:
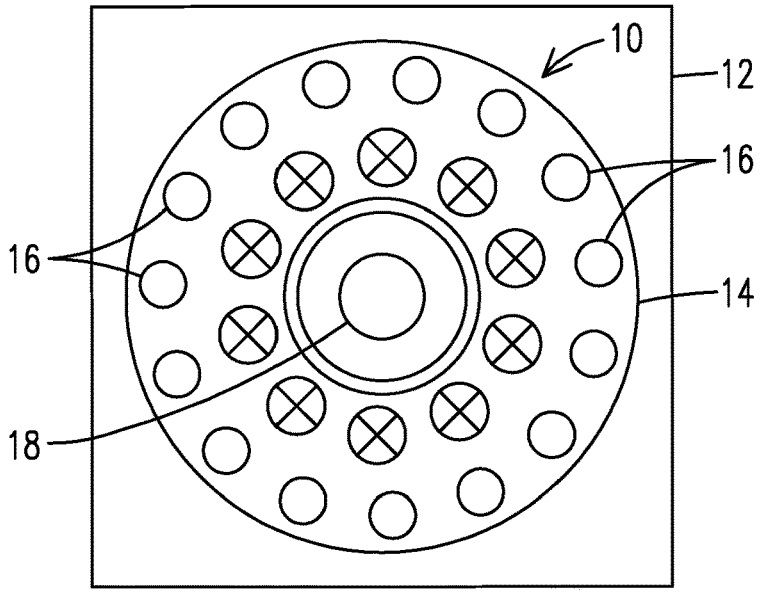
FIG. 1 is a frontal elevational view of one non-limiting embodiment of a disclosed combustor including certain burner mains configured with a body having a different structural feature relative to the bodies of the remaining mains, and selectively grouped to introduce structural asymmetries effective to damp vibrational modes that can develop in the combustor.

The inventors of the present invention have recognized certain issues that can arise in the context of some prior art combustors, as may be used in gas turbine engines. High-frequency combustion dynamics, as may comprise any of various acoustic vibrational modes—e.g., a transverse acoustic mode, where acoustic standing waves can propagate along a radial direction, a circumferential direction, or both radial and circumferential directions—can limit the operational envelope of the engine. In prior art combustors involving substantially symmetrical structures, the level of these vibrational modes may be exacerbated by coherent interaction of acoustic pressure oscillations and heat release oscillations (i.e., thermo-acoustic oscillations), and may result in degraded emissions performance of the combustor and may further lead to a shortened lifetime of the combustor hardware. In view of such a recognition, the present inventors propose an improved combustor and method involving burner mains (hereinafter just referred to as mains) configured to reliably and cost-effectively damp vibrational modes that can develop in the combustor. Structural asymmetries arranged in the mains are effective to reduce coherent interaction of such thermo-acoustic oscillations and, thus, effective to damp vibrational modes that can develop under the high-frequency combustion dynamics in the combustor.

In the following detailed description, various specific details are set forth in order to provide a thorough understanding of such embodiments. However, those skilled in the art will understand that embodiments of the present invention may be practiced without these specific details, that the present invention is not limited to the depicted embodiments, and that the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

FIG. 1 is a frontal elevational view of one non-limiting embodiment of a disclosed combustor 10, as may be used in a turbine engine (schematically represented by block 12), such as a gas turbine engine. Combustor 10 includes a carrier 14 and a plurality of mains 16 that may be annularly disposed in the carrier, for example, about a centrally-disposed pilot burner 18. In one non-limiting embodiment, combustor 10 may comprises a diluted oxygen combustion (DOC) type of combustor.

Figure 2:
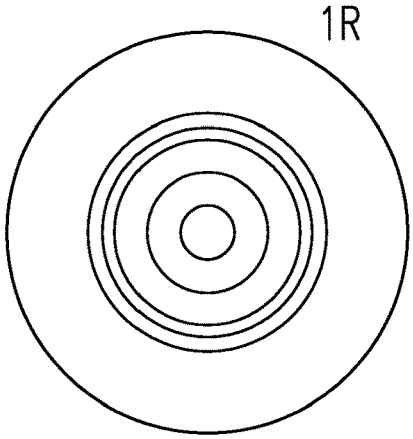
FIG. 2 is a non-limiting example plot of pressure oscillations indicative of a 1R vibrational mode that can be effectively damped with the mains arrangement illustrated in FIG. 1.

In accordance with aspects of the present invention, some of the plurality of mains (designated with the letter X) have a body having a different structural feature relative to the respective bodies of the remaining mains (not designated with any letter). The mains with the different structural feature can be selectively grouped in the carrier to form one or more sets of such mains effective to damp predefined vibrational modes in the combustor, such as without limitation, a 1R vibrational mode, as represented in the plot of pressure oscillations shown in FIG. 2.

In one non-limiting embodiment, the annular arrangement of mains may comprise at least two concentric annuli of mains and the set of mains with the different structural feature may be a set grouped in the radially inner-most annulus of such at least two concentric annuli of mains, as illustrated in FIG. 1.

Figure 3:
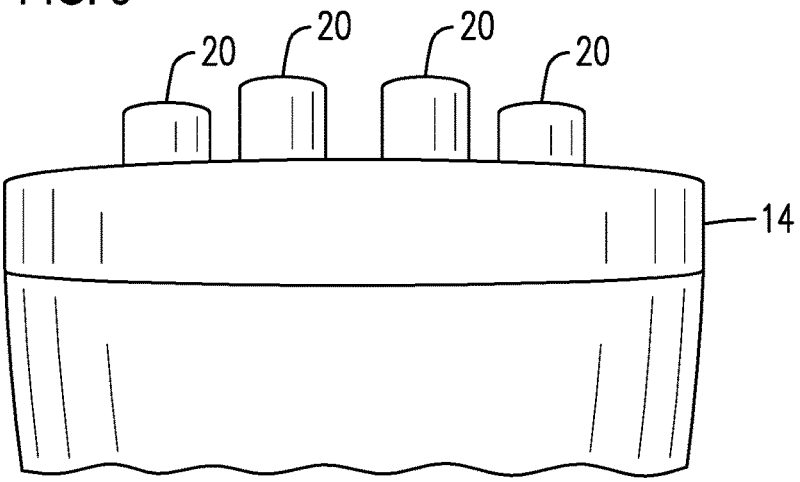
FIG. 3 is a lateral elevational view of one non-limiting embodiment of a disclosed combustor comprising mains with bodies comprising varying axial length.

As may be appreciated in FIG. 3, in one non-limiting embodiment, the different structural feature configured to introduce structural asymmetries may comprise an axial body extension 20 so that the plurality of mains 16 have bodies of different axial length. For example, the mains may be manufactured with an approximately equal axial length and then body extensions 20 may be subsequently affixed (e.g., welding, threaded connection, etc.) to some of the mains. Alternatively, the mains may be manufactured in lots having a different axial length and thus, in this alternative embodiment, body extensions 20 may not be necessary. It will be appreciated that other forms of structural features may be arranged in the mains to provide such structural asymmetries.

Figure 8:
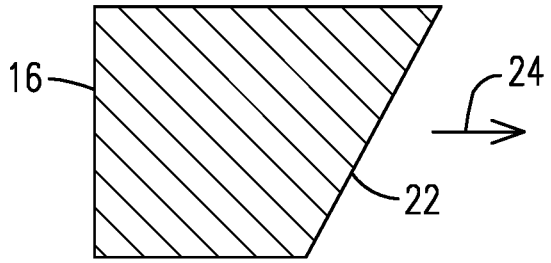
FIGS. 8-10 are respective cross-sectional views illustrating further non-limiting embodiments of different structural features that may be configured in certain of the mains to reduce coherent interaction of thermo-acoustic oscillations, and thus effective to damp vibrational modes in the combustor.
Figure 9:
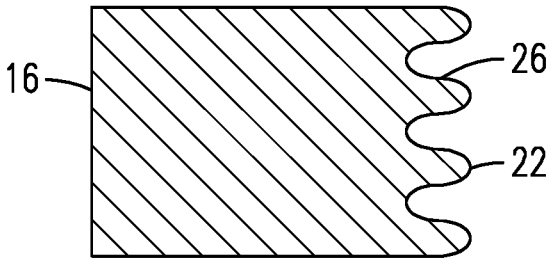
Figure 10:
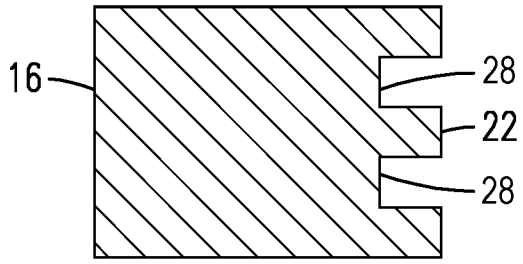

Without limitation, FIGS. 8-10 are respective cross-sectional views illustrating further non-limiting embodiments of different structural features that may constructed in some of the mains to reduce the coherence of such thermo-acoustic oscillations. In one non-limiting embodiment, the respective bodies of the plurality of mains may comprise a tubular body, and, as shown in FIG. 8, some of the mains 16 may comprise a discharge end 22 defining a cross-sectional area that is slanted relative to a longitudinal axis 24 of the tubular body. In another non-limiting embodiment, as shown in FIG. 9, some of the mains 16 may comprise a plurality of undulations 26 that may be constructed at each respective discharge end 22 of such mains. In still another non-limiting embodiment, as shown in FIG. 10, some of the mains 16 may comprise a plurality of castellations 28 that may be constructed at each respective discharge end 22 of such mains. It will be appreciated that the foregoing examples of different structural features that may constructed in some of the mains should be construed in an example sense and not in a limiting sense since aspects of the present invention are not limited to any specific type of structural feature to introduce structural asymmetries.

Figure 4:
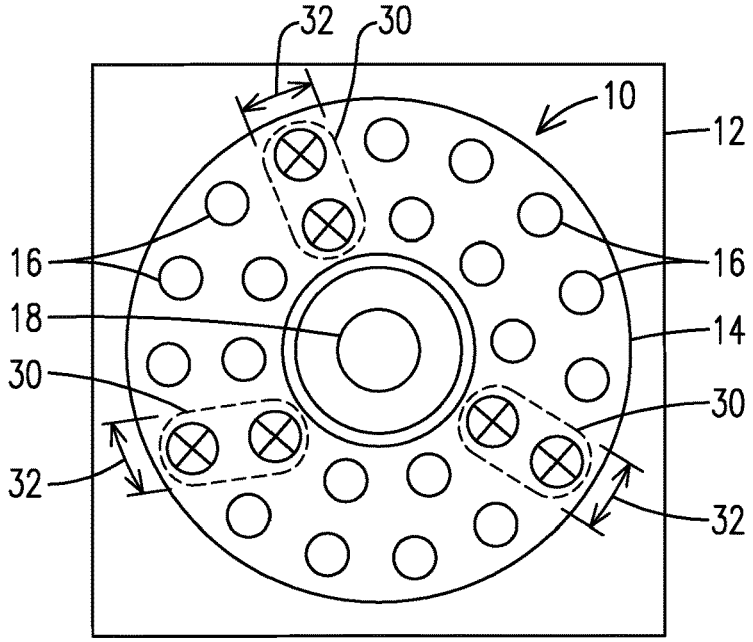
FIG. 4 is a frontal elevational view of a disclosed combustor indicating mains configured with a different structural feature that in another non-limiting embodiment may be selectively grouped to damp a 1T vibrational mode, as indicated in the non-limiting example plot of pressure oscillations shown in FIG. 5.
Figure 5:
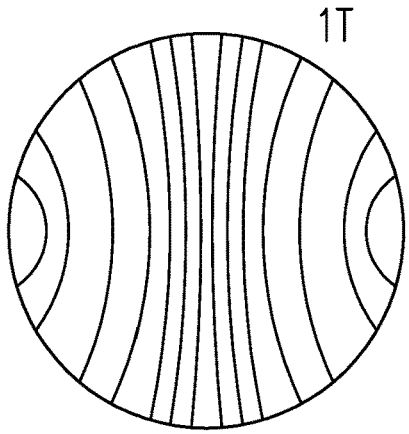
Figure 6:
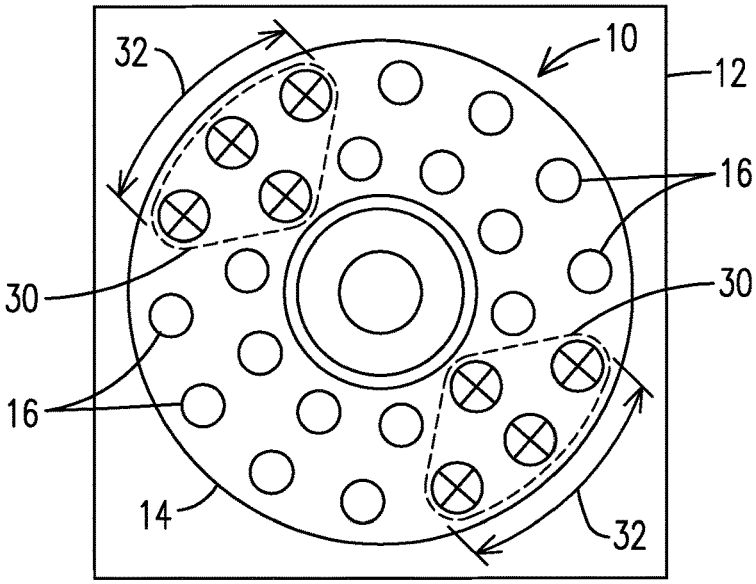
FIG. 6 is a frontal elevational view of a disclosed combustor indicating mains configured with a different structural feature that in yet another non-limiting embodiment may selectively grouped to damp a 2T vibrational mode, as indicated in the non-limiting example plot of pressure oscillations shown in FIG. 7.

As may be appreciated in FIGS. 4 and 6, the mains with different structural features (labelled with the letter X) may comprise respective sets 30 of mains selectively grouped (e.g., symmetrically distributed) over sectors 32 in the two concentric annuli of mains. In the non-limiting example shown in FIG. 4, one can appreciate three respective sets 30 arranged in three equidistant sectors 32 with an angular separation of approximately 120 degrees. In this non-limiting example, sets 30 are effective to damp a 1T vibrational mode, as represented in the plot of pressure oscillations shown in FIG. 5.

Figure 7:
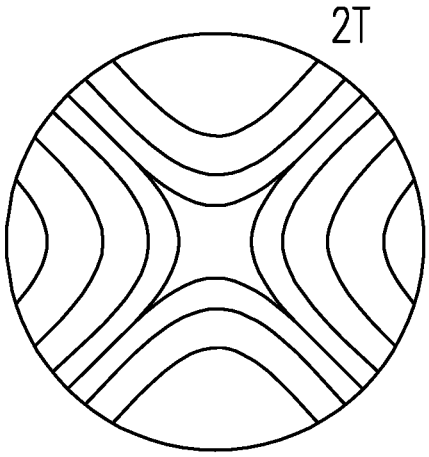

As a further non-limiting example, FIG. 6 illustrates two respective sets 30 arranged in two equidistant sectors 30 with an angular separation of approximately 180 degrees. In this further non-limiting example, sets 30 are effective to damp a 2T vibrational mode, as represented in the plot of pressure oscillations shown in FIG. 7. It will be appreciated that aspects of the present invention are not limited to damping just the specific vibrational modes illustrated in FIGS. 2, 5 and 7. Broadly, depending on the needs of a given application, the sets of mains may be selectively arranged to damp any vibrational modes as may be defined by their appropriate eigenvectors, or to reduce vibrational mode interactions (e.g., inter-mode coupling) that could arise under the high-frequency combustion dynamics.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A combustor comprising:

a burner carrier; and a plurality of burner mains disposed in the burner carrier, wherein some of the plurality of burner mains each comprises a body having a different structural feature relative to the respective bodies of the remaining burner mains, and further wherein said some of the burner mains having the different structural feature are selectively grouped in the burner carrier to form at least one set of said some of the burner mains having the different structural feature effective to damp predefined vibrational modes in the combustor, wherein the plurality of burner mains is disposed in the burner carrier as an annular arrangement comprising at least two concentric annuli of burner mains, wherein said some of the burner mains having the different structural feature are grouped into respective sets over sectors in said at least two concentric annuli of burner mains, and wherein said respective sets are arranged in three equidistant sectors with an angular separation of 120 degrees.

2. The combustor of claim 1, wherein the different structural feature in said some of the burner mains comprises bodies of different axial length relative to the axial length of the respective bodies of the remaining burner mains.

3. The combustor of claim 1, wherein the different structural feature in said some of the burner mains comprises an axial body extension so that the plurality of burner mains have bodies of different axial length.

4. The combustor of claim 1, wherein the different structural feature in said some of the burner mains comprises a plurality of undulations or castellations constructed at each respective discharge end of said some of the burner mains.

5. The combustor of claim 1, wherein the respective bodies of the plurality of burner mains comprises a tubular body, and wherein the different feature in said some of the burner mains comprises a discharge end defining a cross-sectional area that is slanted relative to a longitudinal axis of the tubular body.

6. The combustor of claim 1, wherein the combustor is a diluted oxygen combustor.

7. A method comprising:

providing a burner carrier in a combustor;

disposing a plurality of burner mains in the burner carrier;

arranging in a body of some of the plurality of burner mains a different structural feature relative to the respective bodies of remaining burner mains; and selectively grouping said some of the burner mains having the different structural feature in the burner carrier, the selectively grouping of said some of the burner mains having the different structural feature forming at least one set of said some of the burner mains effective to damp predefined vibrational modes in the combustor;

disposing the plurality of burner mains in the burner carrier in an annular arrangement comprising at least two concentric annuli of burner mains, wherein said some of the burner mains having the different structural feature are grouped into respective sets over sectors in said at least two concentric annuli of burner mains, and wherein said respective sets are arranged in three equidistant sectors with an angular separation of 120 degrees.

8. The method of claim 7, wherein the arranging of the different structural feature in the body of said some of the burner mains is effective to produce a non-coherent response to thermo-acoustic oscillations formed in the combustor.

9. The method of claim 7, wherein the predefined vibrational mode that is damped by said at least one set of said some of the burner mains comprises pressure oscillations selected from the group consisting of circumferential pressure oscillations, radial pressure oscillations, and a combination of circumferential and radial pressure oscillations.

10. The method of claim 7, wherein the arranging of the different structural feature in the body of said some of the burner mains comprises affixing an axial body extension so that the plurality of burner mains have bodies of different axial length.

11. The method of claim 7, wherein the arranging of the different structural feature in the body of said some of the burner mains comprises constructing the plurality of burner mains with bodies of different axial length.

12. The method of claim 7, wherein the arranging of the different structural feature in the body of said some of the burner mains comprises constructing a plurality of undulations or castellations at each respective discharge end of said some of the burner mains.

13. The method of claim 7, wherein the respective bodies of the plurality of burner mains comprises a tubular body, and wherein the different feature in said some of the burner mains comprises a discharge end defining a cross-sectional area that is slanted relative to a longitudinal axis of the tubular body.

* * * * *